United States Patent [19]

Ojala

[11] Patent Number: 4,534,593

[45] Date of Patent: Aug. 13, 1985

[54] VEHICLE SEAT LUMBAR SUPPORT INSERT AND METHOD OF UTILIZING THE SAME

[75] Inventor: William K. Ojala, Dearborn Heights, Mich.

[73] Assignee: Practical Technology Incorporated, Birmingham, Mich.

[21] Appl. No.: 492,191

[22] Filed: May 6, 1983

[51] Int. Cl.[3] ..... A47C 7/46

[52] U.S. Cl. ..... 297/284

[58] Field of Search ..... 297/284, 452, 460; 5/446, 447

[56] References Cited

U.S. PATENT DOCUMENTS

| | | | |
|---|---|---|---|
| 2,259,534 | 10/1941 | Reynolds et al. | 297/452 |
| 2,894,565 | 7/1959 | Conner | 5/436 X |
| 3,495,871 | 2/1970 | Resag et al. | 297/284 |
| 4,239,282 | 12/1980 | White | 297/284 |

OTHER PUBLICATIONS

Booklet titled "Modify Your Bucket Seats for Driving Comfort", Apr. 5, 1982, pp. 10–12.

*Primary Examiner*—William E. Lyddane
*Assistant Examiner*—Peter R. Brown
*Attorney, Agent, or Firm*—John L. Shortley

[57] ABSTRACT

A lumbar support for a vehicle seat comprises two interlocking elements which can be moved into position between a seat back cushion and a seat frame and then interlocked, thus fixing the lumbar support relative the cushion and the frame. The elements can be permanently placed in functioning position without damage to, or alteration of, the seat, without using special tools, and while the seat remains in position in the vehicle.

9 Claims, 12 Drawing Figures

VEHICLE SEAT LUMBAR SUPPORT INSERT AND METHOD OF UTILIZING THE SAME

BACKGROUND OF THE INVENTION

The invention relates to seats for vehicles such as automobiles, and particularly to a means and a method for providing adequate support for the lumbar region of an occupant where the seats as originally built fail to provide adequate support.

Numerous attempts have been made to adjust seats of vehicles to individuals. Some have employed mechanically operable inserts which can be adjusted from the exterior of the seat through mechanical connections. Others have suggested that seat backs should be made in separable sections whereby individual sections can be adjusted and provided with inserts, or exchanged for different configurations of seat sections.

Yet another solution is to purchase a custom built seat from one of the many concerns which will do such custom work.

DESCRIPTION OF PRIOR ART

The prior art includes U.S. Pat. No. 3,973,797, issued Aug. 10, 1976, to Obermeir et al, wherein there is disclosed a linkage, pivot, spring, crank, detent, and other elements which must be added to a seat structure to provide a lumbar support structure. Considerable custom remodeling of the typical original equipment seat would be required to adapt this to an existing seat. Skilled workmen, as well as special tools will be needed to accomplish the task.

U.S. Pat. No. 3,948,558, granted Apr. 6, 1976 to Obermeir et al, likewise shows a structure which could not be readily emplaced by the average non-skilled mechanic. It also employs special structural elements which must be affixed to the seat frame, and requires special tools and skill. Here also an operating lever system with links, springs, detents and a rachet is necessary.

U.S. Pat. No. 3,495,871 provides for modification of a seat structure of a special costly type, which employes separable cushion sections of the type used more for customized seating than for the low cost seating contemplated by the instant invention. In one example the patent discloses clamping of pads between a central cushion portion and a special elastic fabric. The pads are, it appears, to be held in position solely by being clamped between the seat cushion and the elastic fabric.

U.S. Pat. No. 4,182,533, issued Jan. 8, 1980, to Arndt shows yet another form of lumbar support requiring special construction of the seat back frame, and cushion, and involving a multiple number of parts.

SUMMARY

My invention provides a means for correcting the lack of proper back support in vehicles without structural changes in the seats, their frames, or cushions, and without changes in the basic appearances of the seats.

The invention is particularly useful in correcting the lack of support found in a large number of mass produced vehicles, generally, but not exclusively, in the lower price vehicle range, now in service in the North American Market.

According to my invention there is provided a relatively inexpensive, and easy to install structure and method of insertion and fixation thereof, as contrasted to the means and methods of correction heretofore know in the art, which will provide a universal means and method suitable for correction of the problem of lack of support in a number of differing vehicles. According to my invention a single conversion-kit type arrangement will suffice to correct the inadequacy of the seating in a manner satisfactory to the vast majority of motorists having vehicles with inadequate support or who have lower back problems which require the added support.

Further, according to the invention readily insertable elements can be placed in position inside the seat without the need for fastening means, e.g.; drilling, bolting, welding or the like, and yet a secure permanent positioning will be achieved.

In addition, the insertable units can be introduced without damage to and even without removal of the decorative seat cover, without changes in appearance, and without damage to or changes in the seat cushioning material or the frame.

An additional advantage is that the installation can be made while the seats, including their backs, remain in place in the vehicle.

Another advantage according to the invention is that the alteration can be easily done. The average automobile purchaser can readily place the support in proper and fixed location. No special tools are required for most seats. For those which employ "hog" rings for upholstrey closure, the commonly available, inexpensive, yet special tools for working with such rings are desirable, but no other special tools are needed.

Still another feature of the invention is that the lumbar supporting inserts can be locked in place without special tools, drilling or other modifications to the seats, or their cushions, or frames, or covers and without using glue. No changes in the seats are needed yet the lumbar supporting elements can be easily placed in permanent location.

A further advantage of my invention is the provision of a virtual snap in place construction and method which upon simple orientation of elements will lock in place. This contributes greatly to the reliability, as well as the ease of application of the lumbar support. As a result the low cost simple construction according to the invention provides a much needed support which many original seat units fail to provide.

The invention in addition provides a lumbar support adapted to be inserted into a vehicle seat back structure having a resilient cushion element and a frame structure for supporting said seat cushion element, comprising a lumbar support member, said lumbar support member having a front face portion shaped to provide support to the lumbar region of a person seated in front of and bearing against said support member, said support member further having a recess formed in a second face of said support member, said recess forming a lower ledge and an upper ledge, both said ledges extending substantially inwardly from said second face of said support member, and a support bar having a tenon-like section sized to fit snugly into said recess, said support bar having a portion extending outwardly from said tenon-like section and forming a stop member adapted to cooperate with a frame of a seat structure with which it is adapted to cooperate in a manner as to fix said bar and said support member in wedged relationship between a frame and a cushion element forming a seat back with a said frame.

DESCRIPTION OF PREFERRED EMBODIMENT

Figure 1:
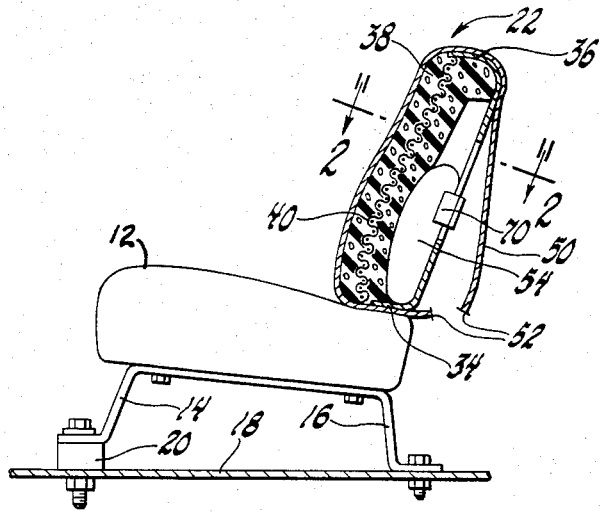
FIG. 1 is a side elevational view, partly in section, of a vehicle seat showing a lumbar support.

Referring now to the drawings: there is shown in FIG. 1 a seat 10 having a seat cushion 12 supported on a frame having foot sections 14 and 16 which are used to attach the seat to a floor pan 18. In the form shown the seat has its height and seat angle adjusted by spacer 20, and the seat is of the individual bucket type such as often provided in two door sport cars, see also FIG. 3. Such seats include a seatback 22 which is pivotally connected to the frame of the fixed seat, and which employs stops and catches for positioning the seat back in operating and non operating positions, and or on an incline. Four-Door Vehicles with bucket seats use the same seat components except the pivot is replaced with either a fixed position brace or an adjustable recliner control which allows the occupant to adjust the seatback angle to suit. All of this is customary in the art and details are not shown for this reason.

A common seat of this type includes a back frame 24, FIGS. 2 to 5. Frame 24 provides a perimeter 26, 28, 30, and 32 of an angle shape and including a lower lip 34 and an upper lip 36, see FIGS. 1 and 5: A foam cushion 38 is received within this angle shaped frame. The cushion has a centrally positioned wire reinforcing member 40 which is typically embedded in the foam. The cushion normally rests against the back frame including sections 42–44, FIG. 5, as well as lips 34 and 36, and is retained in position by the seat back cover and in some cases the inner liner.

The frame has an open upper central section 46 extending downwardly from upper perimeter 32 to about two thirds the way down the back. A ledge 48 is thus formed in the frame above the lower lip 34. A cover 50, conforming to the shape of the cushion and frame, and in the form of a case, receives and conceals the cushion and frame. The cover slips over the seat back cushion and frame. The cover has a zipper type closure 52. In some instances hog clips and or other fasteners are used in place of the zipper closures.

Figure 6:
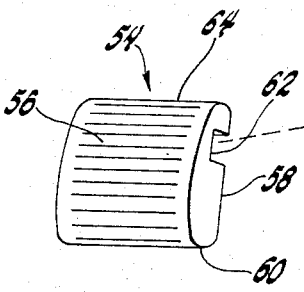
FIG. 6 is a perspective view of a lumbar support element.
Figure 7:
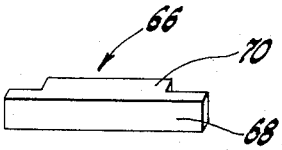
FIG. 7 is a perspective view of a second element, in the form of a tenon.
Figure 8:
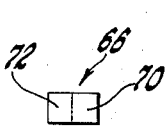
FIG. 8 is a side view of the element of FIG. 7.

A lumbar support member 54, see FIG. 6, preferably in the form of a solid piece of material such as a synthetic material has a front face 56 contoured to provide a lumbar support, a rear vertical face 58 and a lower lip section 60 formed by mergence of the front face 52 and the rear face 54.

Figure 9:
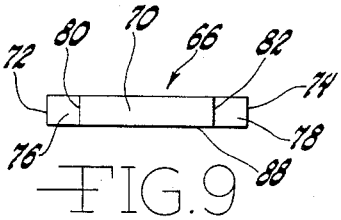
FIG. 9 is a rear view of the element of FIG. 8.
Figure 11:
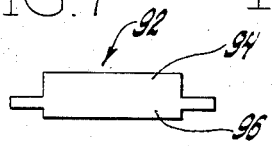
FIG. 11 is a top plan view showing a double tenon-like element of a second form of the invention.
Figure 10:
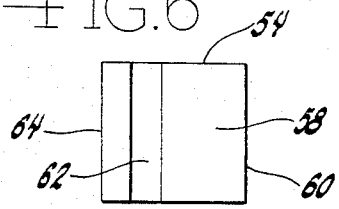
FIG. 10 is a rear view of the lumbar support element of FIG. 6.
Figure 12:
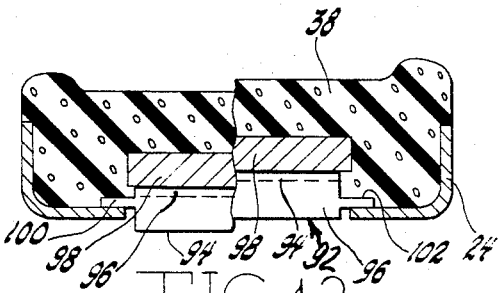
FIG. 12 is a sectional plan view showing the double tenon-like element of FIG. 11 employed in alternative positions relative a lumbar support member and a cushion and seatback frame.

A recess 62 is cut or formed in the rear face of the support member 54 adjacent to but spaced from the upper edge 64 of the member 54. The recess extends completely across member 54 and is parallel to lower lip 60. The recess 62 is in effect a mortise and is designed to receive a tennon-like support bar 66. Support bar 66 has a tennon like section 68 sized and shaped to be snugly received in recess 62. The tennon like section faces toward the front of the seat back when in position. A portion 70 of bar 66 projects outwardly to the rear of the section 68 and forms a stop member. This stop member is spaced inwardly from the opposite ends 72 and 74, see FIG. 9, of bar 66 and there are thus formed two legs 76 and 78 respectively. These legs function to secure the fore and aft position of support member 54, while stop member 70 serves to secure the support member laterally of the seat back, as will be explained below. The Sizing of the mortise and tennon like structure and the stop member 70 is such that the legs 76 and 78 will project to the sides of the lumbar support member 54 while the stop 70 will project outwardly rearwardly of the lumbar support member 54. The tenon-like members can also be cut in an ofset manner according to a second form of the invention so as to provide two levels of lumbar support firmness as shown in FIGS. 11 and 12.

Figure 3:
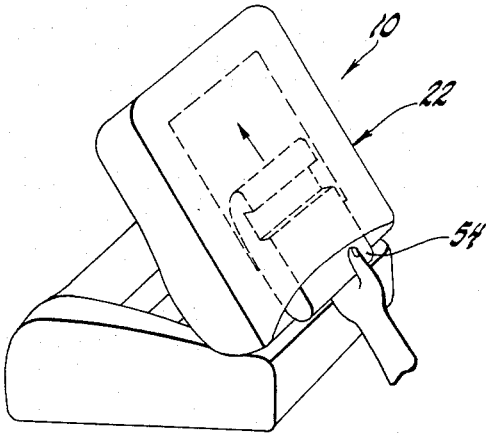
FIG. 3 is a perspective view of the seat of FIG. 1 showing the insertion of a support member.
Figure 2:
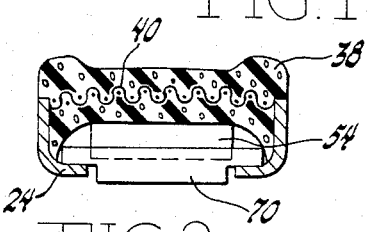
FIG. 2 is a section taken along line 2—2 of FIG. 1.
Figure 4:
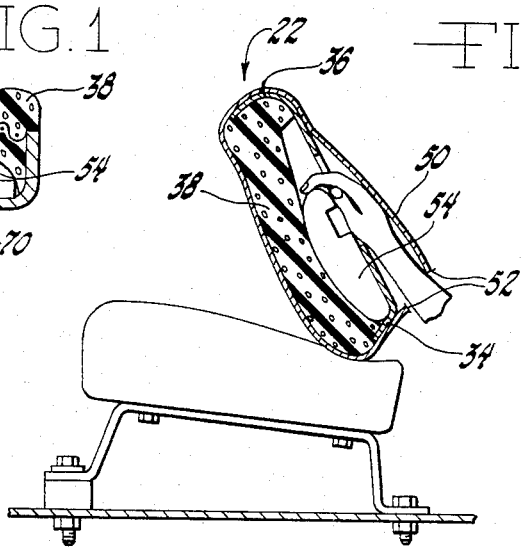
FIG. 4 is a side elevational view partly sectioned, showing a further step, after that shown in FIG. 3, in the insertion of a support member.
Figure 5:
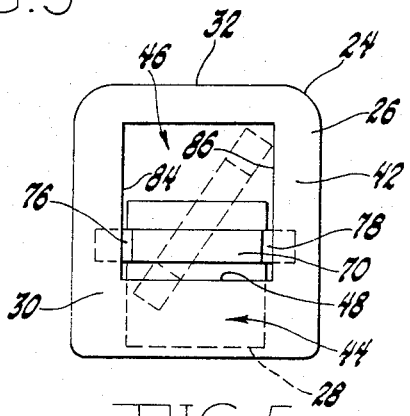
FIG. 5 is a fragmentary rear view of a seat back showing 2 steps (insertion and positioning) after that of FIG. 4, but with the seat cover not shown.

FIGS. 3, 4 and 5 show the manner of inserting the lumbar support member 54 and the tennon like stop member 66 into the seat back. As shown in these Figures and FIGS. 1 and 2, the frame 24 is angle shaped along its edges, and provides lips upon which the cushion 38 bears, and on the lower of which, 34, the lumbar support 54 can be supported. Also the frame has an open upper section 46. The support member 54 is sized such that it can pass through this opening.

With the zipper open the support 54, with the front face 56 facing forwardly, can be forced upwardly by hand between the frame and the cover 50, as shown in FIG. 3, until it is opposite the opening 46, whereupon, the support can be forced through the opening moving the foam away from the frame back, see FIG. 4. Next as shown in FIG. 4 the support can be manually forced downwardly between the foam and the frame until it reaches and is supported upon the lower lip 60. The support can now be left in this position.

The support bar (stop) 66 can now also be inserted up between the cover and the frame while the bar is tilted to a generally diagonal position, as indicated in dotted lines in FIG. 5, until it is within the opening 46, and abutting the lumbar support member 54.

Now the support bar with the tenon-like portion 68 facing forward can be moved downwardly and simultaneously rotated while bearing against the upper end of the lumbar support member 54 until it is horizontally aligned with the mortice like opening 62 in support 54, whereupon tenon-like portion 68 can be snapped into the latter opening 62 with the legs 76 and 78 projecting beyond the sides of member 54 and into engagement, respectively, with the forward facing portions of the flanges 26 and 30 of the frame. When this occurs the stop portion 70 will project rearwardly through the opening 46, and its edges 80 and 82 will closely face the vertical sides 84 and 86 of the frame which define the sides of the opening 46. The lower edge 88 of the stop portion 70 will be closely adjacent the ledge 48 of the frame section forming the opening 46.

The cushion will force the support 54 with its tenon-like support bar backwardly against the frame 24. Vertical support will be provided by either the lip 34 of the frame member; or the seat cover itself, and horizontal stability will be provided by member 66. The latter support, 66, will also provide vertical support where lip 36 is inadequate or not available.

With the elements in place the zipper can be closed. With proper design of the elements no change in appearance of the seat will be visible except the lumbar region will be seen to project slightly forward upon close inspection. By contouring the member 54 as shown in FIGS. 4 and 6 the occupant will find that support of his back is greatly improved. It is contemplated that a single lumbar support kit will suffice, and thus a universally useful lumbar support is provided for use where such support is woefully lacking in standard seats. Inevitable manufacturing design changes may require corresponding dimensional changes in 54 and 66 without departing from the inventions' concept.

As shown in FIGS. 11 and 12 a second form of support bar 92 has a pair of members 94 and 96 which function alternately as tenon-like sections and stop members. Thus there is a pair of tenon-like members and a pair of stop members provided by the single elongated support bar 92. Member 94 projects outwardly from the central major axis 95 of support bar 92 a greater distance than does member 96. Accordingly when member 94 is received as a tenon-like member in lumbar support member 98, as in FIG. 12, and stops 100 and 102 engage back frame 24 the lumbar member will project forwardly from back frame 24 a greater distance than the lumbar support member will when the support bar is rotated 180 degrees and tenon-like member 96 is positioned in the mortice of lumbar support member 98, also as shown in FIG. 12. Thus a selection between two degrees of lumbar support is possible with the support bar 92. This in effect provides two levels of lumbar support firmness. This is achieved by the unsymetrical tenon configuration shown in FIGS. 11 and 12. The support bar is rotated axially to provide two levels of lumbar support firmness.

From the above it is apparent that my invention provides a simple, inexpensive yet reliable means and method for providing more adequate lumbar support in vehicle seats without damage to or modification of the seats. A much more comfortable ride will be achieved, with less fatigue, particularly over long distances, through use of my invention. The elements can be simply inserted into operating position by one of modest skill. Two relatively simply formed elements designed to snap into interlocked connection by manual manipulation can be fixedly positioned within seats without structural change or undesirable changes in appearance. Furthermore cranks, additional frame members, springs, rods, etc. are unnecessary. On the other hand the elements are positively fixed without reliance on gluing, yet they are fixed in a manner far superior to what might be obtained by reliance solely on pressure between a foam cushion and elastic members.

While I have shown and described a preferred form of my invention, it will be understood that many changes in detail and form may be made, and I accordingly claim all forms and methods within the scope of the appended claims.

What I claim is:

1. A vehicle lumbar support adapted to be inserted into a vehicle seat back structure having a resilient cushion element and a substantially vertically extending frame for supporting said cushion element, said frame comprising a perimeter formed to receive and retain a cushion, said frame having an open upper section defined by a portion of said perimeter and extending downwardly from upper portions of said perimeter, said support comprising;

a lumbar support member;

said lumbar support member having a front face portion shaped to provide support to the lumbar region of a person seated in front of and bearing against a said cushion element;

said lumbar support member furthur having a second face, a recess formed in said second face of said lumbar support member, said recess having a lower ledge and an upper ledge, both said ledges extending inwardly from said second face of said lumbar support member; and a support bar having a tenon-like section sized to snugly fit into said recess and bear vertically against both said ledges;

said support bar having a portion extending outwardly from said tenon-like section a distance sufficient to extend outwardly from said support member second face when said tenon-like section is snugly fitted into said recess, the latter said support bar portion forming a stop member adapted to extend between parallel portions of a said perimeter of a said frame within a said open section to form a stop limiting movement of said lumbar support member transversely of said parallel portions of a said perimeter when received between said parallel portions of a said perimeter with said support bar received snugly within said recess with said stop member projecting outwardly of said lumbar support member, and when said stop member is centrally positioned laterally of said parallel portions of said perimeter, with said support member positioned between a cushion element supported by a said frame and a latter said frame.

2. The lumbar support of claim 1 including said lumbar support member having a lower lip like portion extending between said front face portion and said second face thereof, and forming a bottom ledge for fixing said lumbar support member in respect to a lower ledge on a seat frame.

3. The lumbar support of claim 2 wherein said lower lip like portion is formed by the mergence of said front face portion and said second face thereof adjacent the bottom thereof.

4. The lumbar support of claim 2 wherein said recess is positioned substantially adjacent the upper end of said lumbar support member as contrasted with the location of said lip like portion thereof.

5. The vehicle lumbar support of claim 1 including said recess in said lumbar support member extending completely from one side to an opposite side of said lumbar support member, and substantially parallel to said front face portion and said second face of said lumbar support member.

6. The vehicle lumbar support of claim 1 including, said support bar tenon-like section extending outwardly beyond opposite sides of said second face of said lumbar support member to form supporting legs extending to opposite sides of said lumbar support member when said support bar tenon-like section is centrally positioned within said lumbar support member for supporting said lumbar support member in wedged relationship between a frame and a cushion element.

7. The vehicle lumbar support of claim 6 wherein said outwardly extending stop member portion of said support bar projects outwardly from said support bar between said supporting legs.

8. A vehicle lumbar support adapted to be inserted into a vehicle seat back structure having a resilient cushion element and a substantially vertically extending frame for supporting said cushion element, said frame comprising a perimeter formed to receive and retain a cushion, said frame having an open upper section defined by said perimeter and extending downwardly from upper portions of said perimeter, said support comprising;

a lumbar support member;

said lumbar support member having a front face portion shaped to provide support to the lumbar region of a person seated in front of and bearing against a said cushion element;

said lumber support member further having a second face, a recess formed in said second face of said lumbar support member, said recess having a lower ledge and an upper ledge, both said ledges extending inwardly from said second face of said lumbar support member, and a support bar having a pair of members which form tenon-like sections with each sized to snugly fit into said recess and bear vertically against both said ledges, and each one of said tenon-like sections projecting outwardly from a central axis of said support bar;

a first one of said tenon-like sections projecting outwardly from said central axis of said support bar a greater distance than the second one of said pair of tenon-like sections projects outwardly from said central axis of said support bar;

said support bar having means forming a pair of portions thereof each extending respectively outwardly of said support bar and outwardly with respect to a respective one of said tenon-like sections a distance sufficient respectively to extend from said support member second face when the latter one of said respective tenon-like sections is snugly fitted into said recess; and each one of said means forming a pair of portions forming a stop member adapted to extend between parallel portions of a said perimeter of a said frame within a said open section thereof to form a stop limiting movement of said lumbar support member transversely of said parallel portions of a said perimeter when received between said parallel portions of a said perimeter with a selected one of said tenon-like sections of said support bar snugly received within said recess with the latter said stop member projecting outwardly of said lumbar support member, and when the latter said stop member is centrally positioned laterally of said parallel portions of said perimeter, with said support member positioned between a cushion element supported by a said frame and a latter said frame.

9. The vehicle lumbar support of claim 8 wherein said pair of members which form tenon-like sections are positioned 180 degrees apart from each other with respect to said central axis of said support bar.

* * * * *